US007694449B1

(12) United States Patent
Pontillo, II

(10) Patent No.: US 7,694,449 B1
(45) Date of Patent: Apr. 13, 2010

(54) PLASTIC PISTOLS

(76) Inventor: James V. Pontillo, II, 1752 Meadowlark La., Anaheim, CA (US) 92806

( * ) Notice: Subject to any disclaimer, the term of this patent is extended or adjusted under 35 U.S.C. 154(b) by 420 days.

(21) Appl. No.: 11/066,714

(22) Filed: Feb. 24, 2005

Related U.S. Application Data

(60) Provisional application No. 60/547,647, filed on Feb. 25, 2004.

(51) Int. Cl.
*F41C 23/10* (2006.01)

(52) U.S. Cl. ..... 42/71.02; 42/75.02

(58) Field of Classification Search ..... 42/41.02, 42/71.02, 75.02
See application file for complete search history.

(56) References Cited

U.S. PATENT DOCUMENTS

| | | | | | |
|---|---|---|---|---|---|
| 2,296,729 | A | * | 9/1942 | Mossberg | 42/50 |
| 2,507,364 | A | * | 5/1950 | Benson | 42/50 |
| 3,249,048 | A | * | 5/1966 | Kerr | 102/447 |
| 3,696,706 | A | | 10/1972 | Seidel et al. | |
| 3,765,116 | A | * | 10/1973 | Zaid | 42/89 |
| 4,539,889 | A | | 9/1985 | Glock | |
| 4,615,132 | A | * | 10/1986 | Smith | 42/25 |
| 4,769,938 | A | * | 9/1988 | Chesnut et al. | 42/76.02 |
| 4,825,744 | A | | 5/1989 | Glock | |
| 4,893,546 | A | | 1/1990 | Glock | |
| 4,936,036 | A | * | 6/1990 | Sniezak et al. | 42/71.02 |
| 5,272,957 | A | * | 12/1993 | Chesnut et al. | 89/195 |
| 5,386,657 | A | | 2/1995 | Racheli | |
| 5,437,118 | A | * | 8/1995 | Sniezak et al. | 42/7 |
| 5,669,169 | A | * | 9/1997 | Schmitter et al. | 42/75.01 |
| 6,070,354 | A | * | 6/2000 | Burigana et al. | 42/71.01 |
| 6,260,301 | B1 | * | 7/2001 | Aigner et al. | 42/71.02 |
| 6,295,751 | B1 | * | 10/2001 | Piwonski | 42/1.15 |
| 6,397,508 | B1 | * | 6/2002 | Constant et al. | 42/84 |
| 6,405,473 | B1 | * | 6/2002 | Petig et al. | 42/84 |
| 6,694,658 | B1 | * | 2/2004 | Marsac | 42/54 |
| 6,789,342 | B2 | * | 9/2004 | Wonisch et al. | 42/75.02 |
| 7,117,796 | B1 | * | 10/2006 | Bogle et al. | 102/275.6 |
| 2006/0096147 | A1 | * | 5/2006 | Gussalli | 42/71.02 |
| 2006/0249014 | A1 | * | 11/2006 | Curry | 89/196 |
| 2006/0272192 | A1 | * | 12/2006 | Zimmermann | 42/7 |

* cited by examiner

*Primary Examiner*—Troy Chambers
(74) *Attorney, Agent, or Firm*—Blakely Sokoloff Taylor & Zafman LLP

(57) ABSTRACT

The present invention comprises plastic pistols and individual parts therefore having an increased use of plastic in comparison to prior art plastic pistols, reducing the number and simplifying the design of the metal parts to reduce the cost of the pistols while still maintaining gun quality. One aspect of the invention is the use of plastic in certain critical areas, simplifying the configuration of the metal inserts used. In many cases, this can eliminate expensive machining of metal parts in favor of parts injection molded to finished dimensions. In that regard, legal requirements can still be met with respect to metal content, yet that metal content may be simplified in configuration for ease of manufacture. Certain preferred embodiments of the invention are illustrated.

25 Claims, 14 Drawing Sheets

SECTION B-B

SECTION A-A

SECTION C-C

Plastic
Steel
SECTION B-B

A
A

B
B
C
C

Plastic
SECTION C-C

Steel
Breech Face
Polymer
SECTION A-A

SECTION A-A

SECTION A-A

Tang detail in magazine base to depress follower in magazine assembly to ease loading of ammunition.

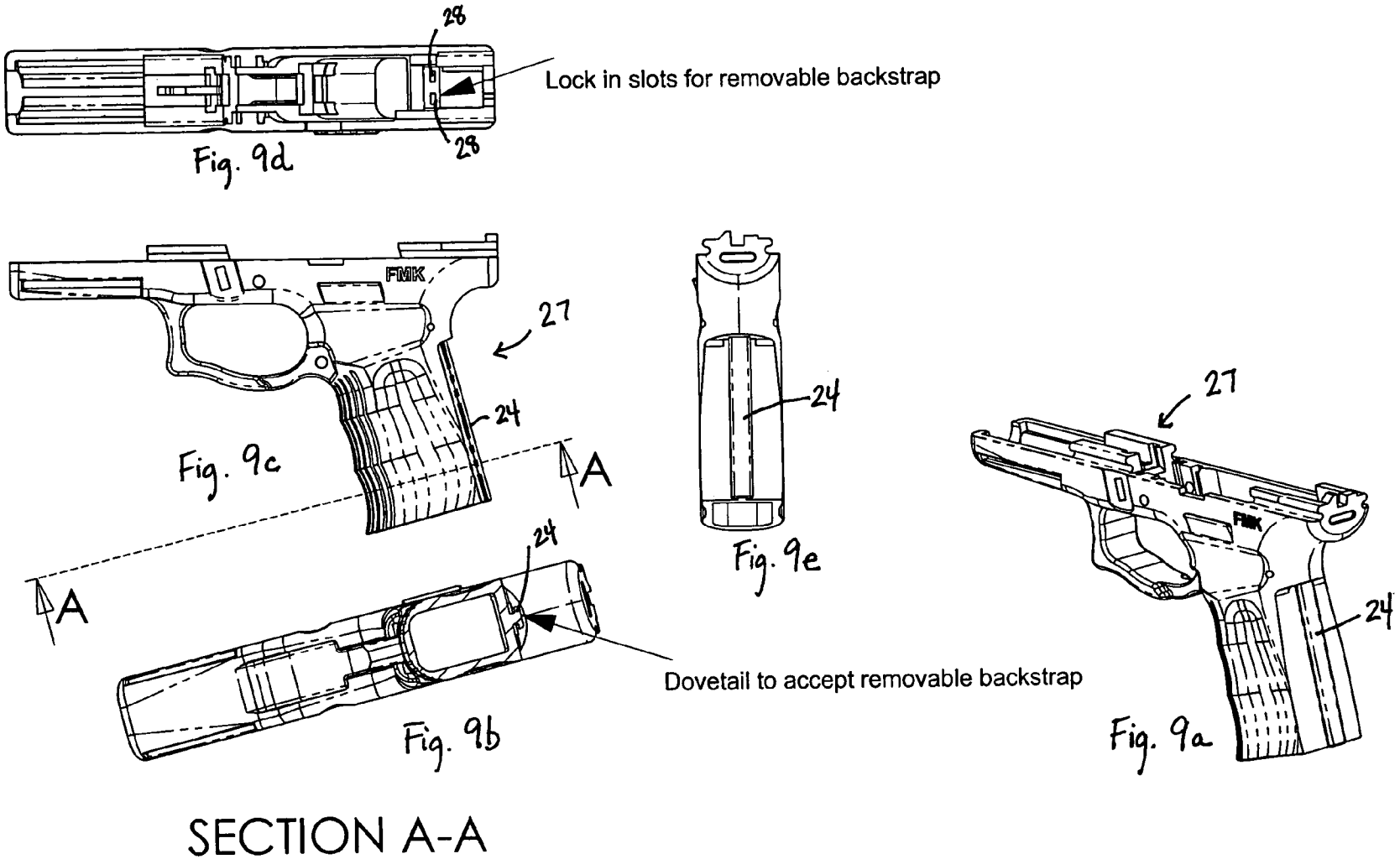
SECTION A-A

Rubber or silicone backstrap attached using removable backstrap with dovetail and clips

SECTION G-G

| PART # | DESCRIPTION |
|---|---|
| 7000X | Frame (not available) |
| 7921 | Slide (specify color) |
| 7928 | Trigger Disconnector |
| 2031 | Trigger Cross Pin |
| 7972 | Sear |
| 2042 | Sear Spring |
| 5925T | Recoil Spring |
| 7940 | Ejector |
| 7924 | Cam |
| 2036 | Cam Pin |
| 7914 | Magazine Release |
| 7959 | Mag. Release Spring |
| 7918 | Safety Lever |
| 7990 | Safety Pin |
| 7919 | Safety Spring |
| 7981 | Spacer |
| 7950M | Disassembly Button |
| 7951 | Disassembly Spring |
| 7960P | Grips (pair) |
| 2021 | Grip Screw |
| 7964 | Firing Pin |
| 3826 | Firing Pin Spring |
| 7837 | Retainer |
| 7938 | Retainer Pin |
| 7982 | Magazine |
| 5912 | Extractor |
| 5933 | Extractor Spring |
| 2031R | Extractor Pin |
| 7957C | Rear Sight Kit |
| 7971 | Instruction Manual |
| 7916 | Trigger Sub Ass. |

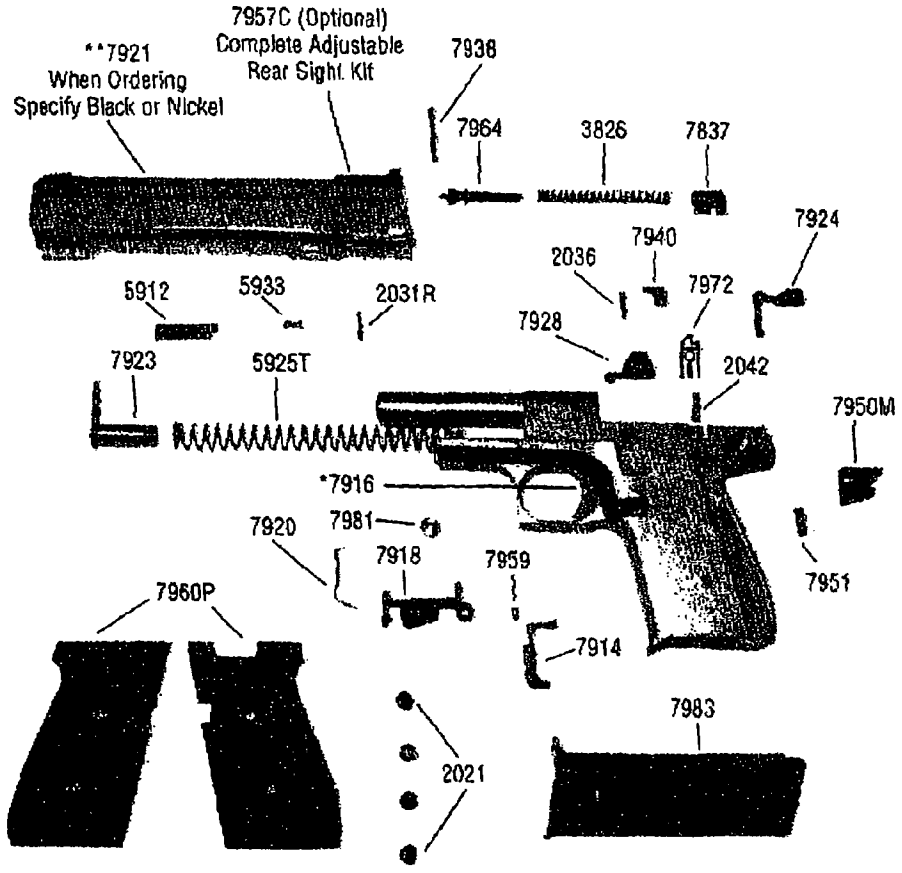

Fig. 13

PLASTIC PISTOLS

CROSS-REFERENCE TO RELATED APPLICATION

This application claims the benefit of U.S. Provisional Patent Application No. 60/547,647 filed Feb. 25, 2004.

BACKGROUND OF THE INVENTION

1. Field of the Invention

The present invention relates to the field of handguns, and more particularly semiautomatic handguns.

2. Prior Art

An automatic pistol carries a slide/barrel assembly that slides longitudinally along a frame. A spring braced between the slide and frame holds the slide/barrel assembly in a forward and closed position. A cartridge chamber exists within this slide/barrel assembly. In the forward position, the rear end of the barrel is covered by the breech face upon the slide. A hole in the breech face provides access to the cartridge chamber for a firing element to pierce the primer of the pistol cartridge, thereby discharging the cartridge and expelling the bullet.

The firing element can be driven forward by a hammer striking it, or it can be moved backward under spring pressure and released to drive the firing element forward through the breech face to the primer. In either instance the hammer or the firing element itself is connected through mechanical means to a trigger operated by the user.

Upon discharge of a pistol cartridge, a bullet travels forward out through the barrel, the slide/barrel assembly moves rearward for a specific distance where the barrel moves slightly downward and stops, the slide continues to move rearward opening the cartridge chamber. The extractor (through spring pressure) holds the spent cartridge casing to the breech face, removing it from the barrel. As the slide continues rearward, the ejector (mounted in the frame) contacts the spent cartridge casing, pushing it away from the breech face, causing the extractor spring pressure to be overcome to expel the empty cartridge from the pistol.

Now at maximum rearward travel, the slide has cleared the magazine assembly, allowing the next cartridge in the magazine to move up (magazine cartridges are loaded under spring pressure). Spring pressure pushes the slide forward contacting the next cartridge from the magazine and delivering it to the cartridge chamber which closes as the slide moves forward. Slide fully forward, the pistol is loaded ready to fire again.

This generally describes the operation of an automatic pistol with a locked breech mechanism, fired either by striker or hammer operation. A straight blowback mechanism operates similarly. However, the barrel is not part of a slide/barrel assembly; it is integrally and rigidly mounted to the frame. The slide, containing the breech face, is held forward closing the cartridge chamber only by spring force and with no particular mechanical interlock.

Whether hammer or striker fired, various pistol mechanisms are employed to facilitate the forward movement of the firing element:

In a DAO (Double Action Only) mechanism, actuating the trigger pulls back the hammer (or striker) to a critical point and then releases it in one smooth motion.

In a single action mechanism, the pistol must be manually "cocked" by racking the slide rearward or by pulling the hammer back. Trigger actuation will then release the "cocked" element driving the firing element forward through the breech face. Following the initial discharge of the pistol, sequential shots may not require manually "cocking" of the firing element, as the pistols operation will leave the device in a "cocked" condition following each firing.

Specific to the Glock firearm (U.S. Pat. Nos. 4,539,889, 4,825,744 and 4,893,546) is an intermediate action mechanism. This device works like a single action mechanism, however, it has characteristics of the DAO as well. It must be manually "cocked" before the first discharge, and sequential firings require only trigger actuation. The sequential trigger operations do not solely release a firing element, however (as in the single action design), they serve to actuate the firing element from an intermediate position to the critical point where release takes place, actuating the firing element. This design allows a trigger pull distance that is less than in the DAO and greater than in the single-action. Most importantly, it maintains the firearm in a partially "cocked" position where accidental discharge by dropping the weapon is impossible (a single action design makes inadvertent discharge through dropping prevalent), since the intermediate position of the firing element does not have enough spring tension to drive the firing element through the breech face if released.

Classically, semiautomatic handguns have been substantially all metal, except for the handgrip, which often included plastic, wood or other material for comfort and esthetic purposes. More recently, plastic has been sometimes used in other parts of semiautomatic handguns as a means of cost reduction, though typically in conjunction with metal parts that define the critical operating parts and surfaces. As such, the metal parts are still relatively expensive because of their complexity and machining requirements, thereby limiting the cost reduction that can be achieved.

BRIEF DESCRIPTION OF THE DRAWINGS

FIGS. 9*a* through 9*e* are views of a handgun frame to which the back strap of FIGS. 8*a* through 8*d* attaches in accordance with an embodiment of the present invention.

FIG. 13 is an exploded view of a straight blow back handgun in which the construction of FIGS. 12*a* through 12*d* may be used.

DETAILED DESCRIPTION OF THE PREFERRED EMBODIMENTS

In the prior art section, pistols of various well known designs were described. In general, the present invention is applicable to such pistols, no matter which kind and independent of the detailed design of its various parts. Accordingly, details of such pistols that are already well known will not be set forth herein, as such are well within the knowledge of those skilled in the art. Instead, details will only be given as they effect the design and/or fabrication of such parts of the pistols.

In particular, the present invention comprises plastic pistols and individual parts therefore having an increased use of plastic in comparison to prior art plastic pistols, reducing the number and simplifying the design of the metal parts to reduce the cost of the pistols while still maintaining gun quality. One aspect of the invention is the use of plastic in certain critical areas, simplifying the configuration of the metal inserts used. In many cases, this can eliminate expensive machining of metal parts in favor of parts injection molded to finished dimensions. In that regard, legal requirements can still be met with respect to metal content, yet that metal content may be simplified in configuration for ease of manufacture. Certain preferred embodiments of the invention are illustrated in the attached drawings as follows.

Figure 1:
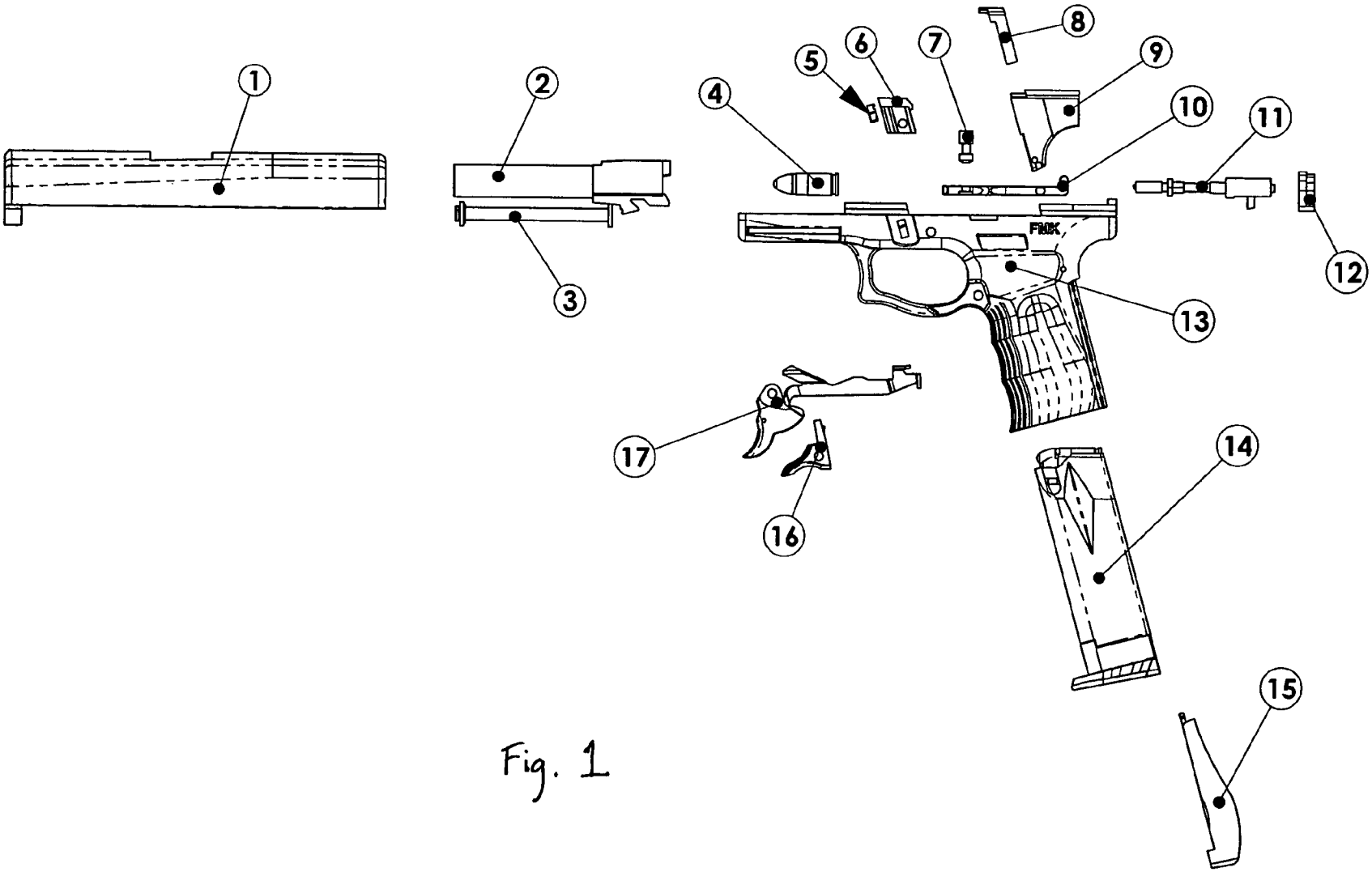
FIG. 1 is an exploded view of a handgun that may be fabricated in accordance with a preferred embodiment of the present invention.
Figure 2F:
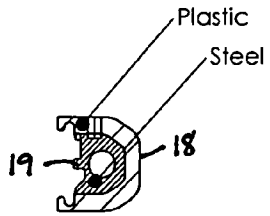
FIGS. 2*a* through 2*g* are views of a slide in accordance with an embodiment of the present invention for the handgun of FIG. 1.
Figure 2G:
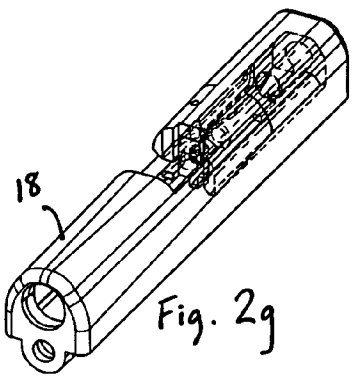
Figure 2A:
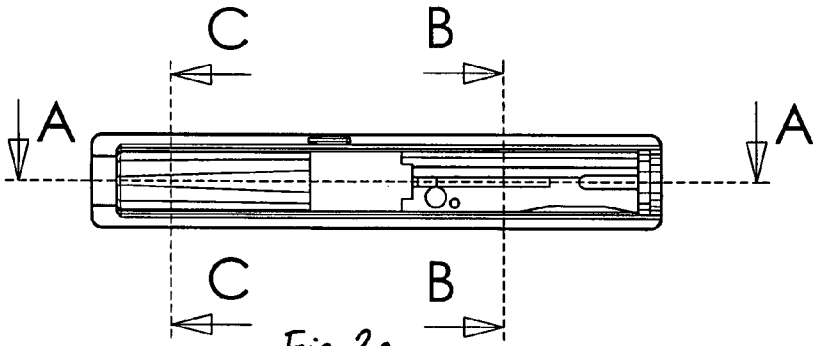
Figure 2B:
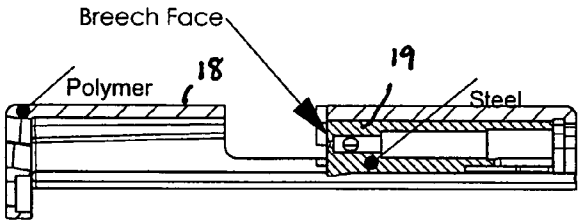
Figure 2C:
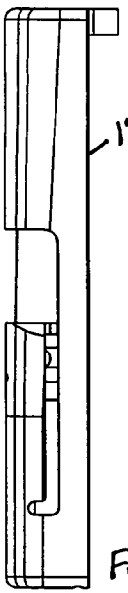
Figure 2E:
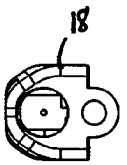
Figure 2D:
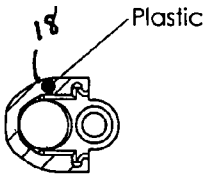
Figures 3A, 3B, 3C, 3D, 3E, 3F, 3G:
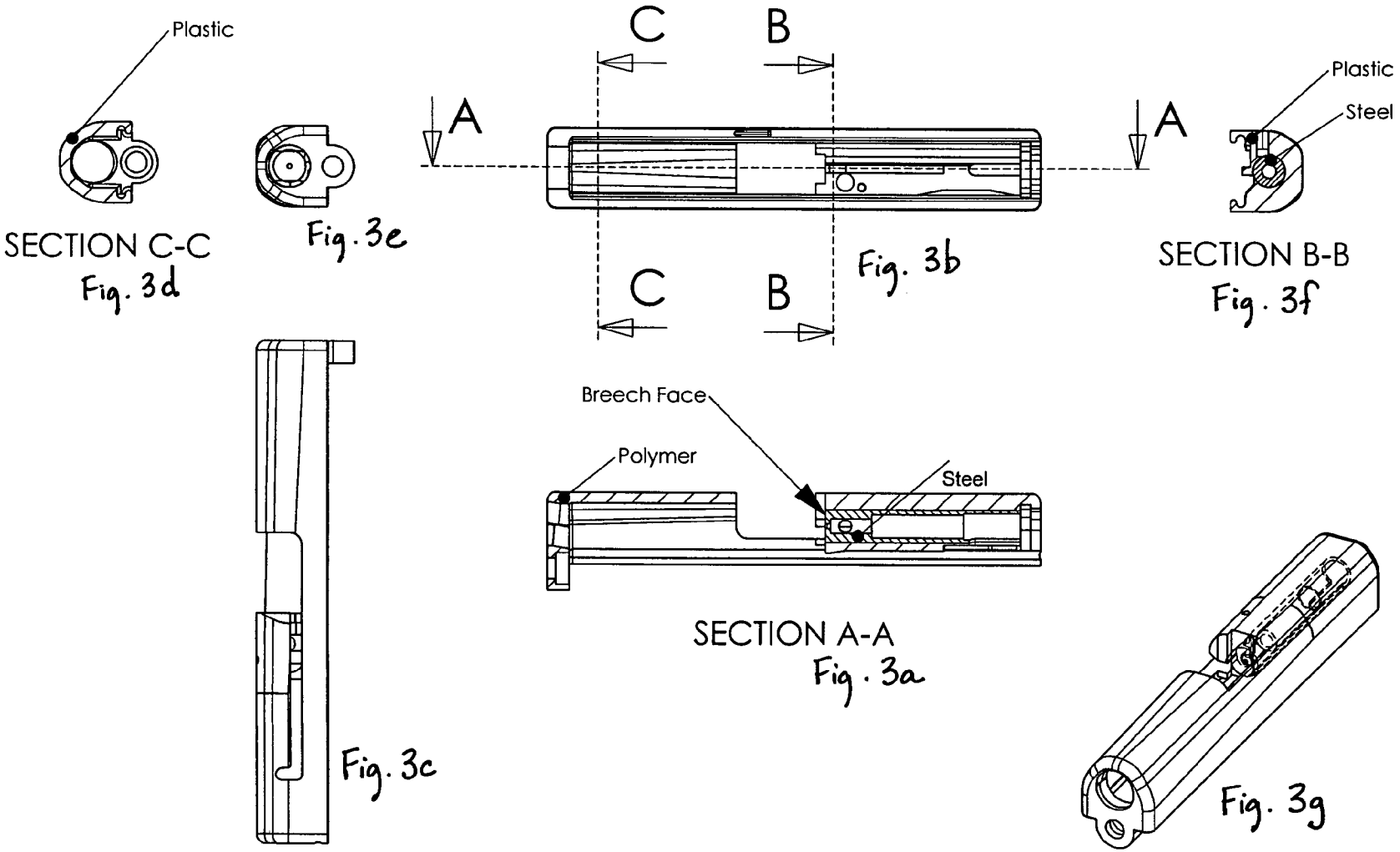
FIGS. 3*a* through 3*g* are views of an alternate slide in accordance with an embodiment of the present invention for the handgun of FIG. 1.
Figure 4B:
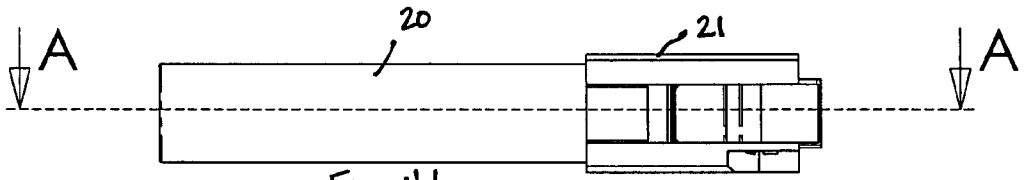
FIGS. 4*a* through 4*e* are views of a gun barrel and locking block in accordance with an embodiment of the present invention for the handgun of FIG. 1.
Figure 4A:
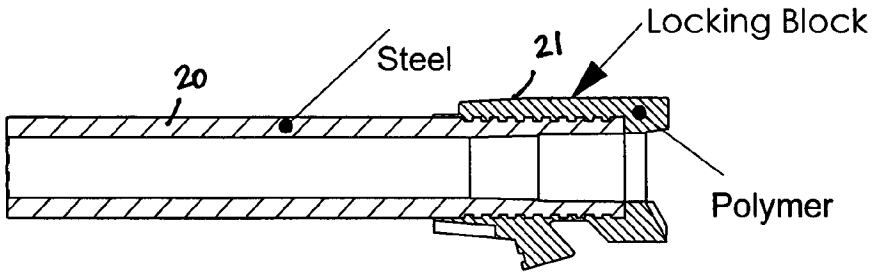
Figure 4E:
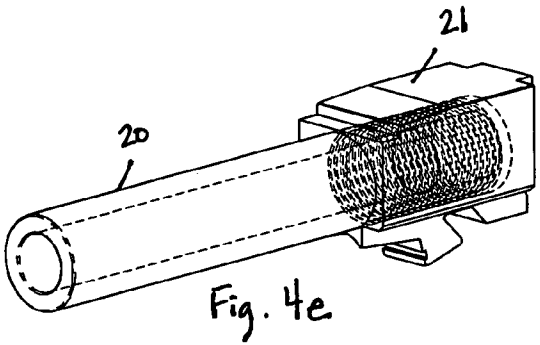
Figure 4D:
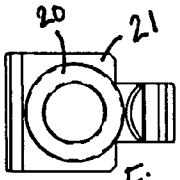
Figure 4C:
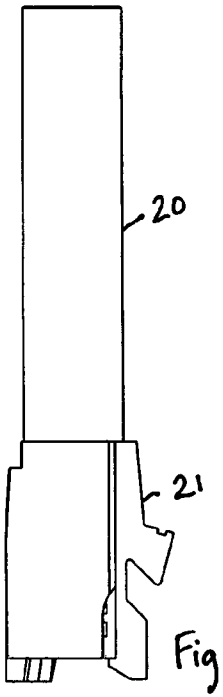
Figure 5B:
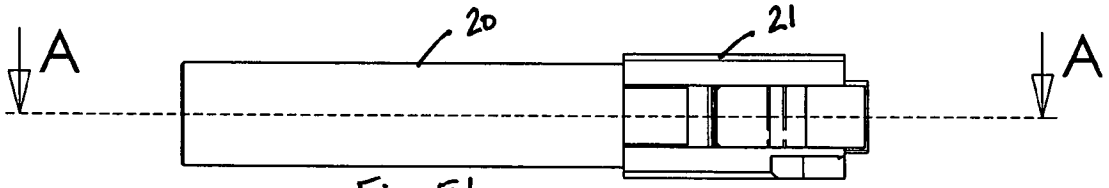
FIGS. 5*a* through 5*e* are views of an alternate gun barrel and locking block in accordance with an embodiment of the present invention for the handgun of FIG. 1.
Figure 5A:
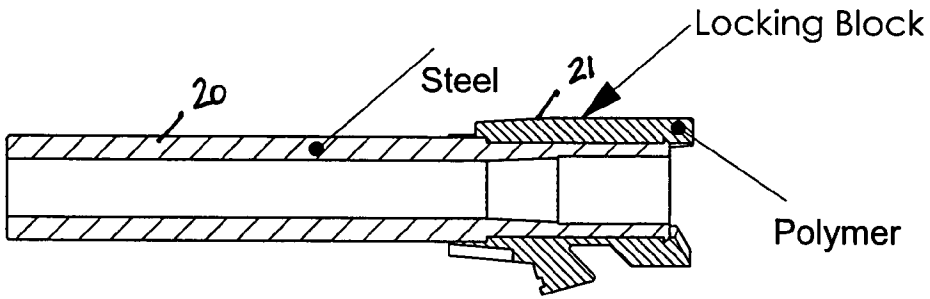
Figure 5E:
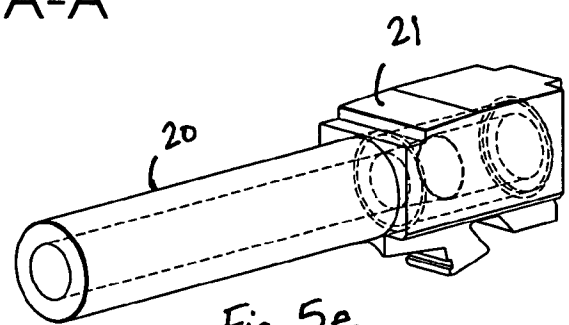
Figure 5D:
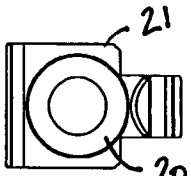
Figure 5C:
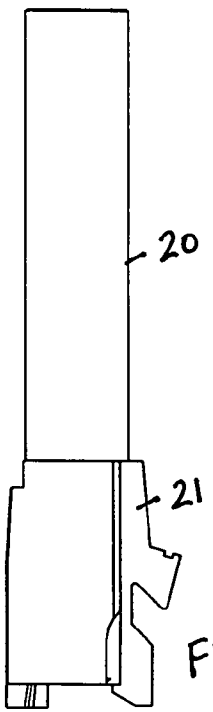
Figure 6A:
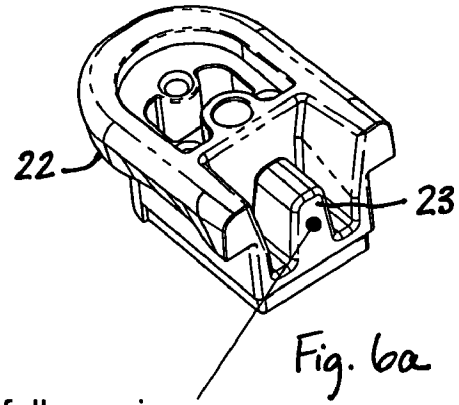
FIGS. 6*a* through 6*d* are views of a magazine base in accordance with an embodiment of the present invention.
Figure 6B:
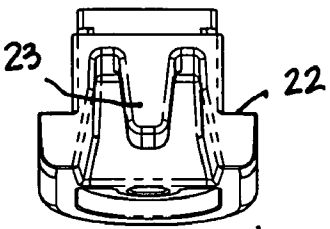
Figure 6D:
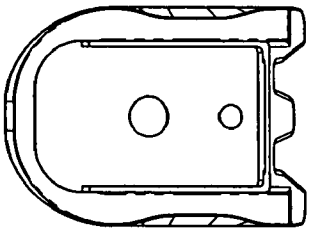
Figure 6C:
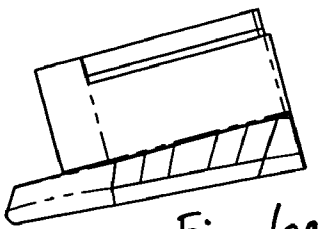

FIG. 1 is an exploded view of a handgun in accordance with one embodiment of the present invention. In this Figure, the various major parts are labeled 1 through 17 as follows:

1 Slide
2 Barrel
3 Recoil spring retaining assembly
4 Bullet
5 Barrel release
6 Barrel guide
7 Firing pin block
8 Ejector
9 Rear housing
10 Extractor
11 Striker assembly
12 End cap-slide
13 Frame
14 Magazine assembly
15 Frame backstrap
16 Magazine release
17 Trigger-Safety-Trigger bar assembly While the gun specifically illustrated is of the striker type, most of the major parts for a hammer fired handgun are similar, and accordingly the gun of FIG. 1 is presented as generic as to locked breech handguns in which the present invention may be used.

FIGS. 2*a* through 2*g* show the construction of a pistol slide manufactured from plastic 18 with a steel form 19 molded in. The steel form 19 forms the breech face and supports the bullet in firing position. The steel form 19 also cores out thick plastic sections necessary for plastic manufacturability. Note that the slide surfaces themselves, as well as other complicated surfaces, expensive to machine, are plastic, preferably molded to finished dimensions.

FIGS. 3*a* through 3*g* show an alternate construction of a pistol slide manufactured from plastic 18 with a steel form 19 either molded in or pressed in. Here the steel form 19 might be a simple steel tube, a steel tube with a roughened outer surface and/or with a flange for mechanical retention in the plastic. Again the slide surfaces are plastic and preferable molded to finished dimensions.

FIGS. 4*a* through 4*e* show a pistol gun barrel 20 of steel with an integral molded in place locking block 21 manufactured from plastic. Traditionally, these are one solid piece. By molding the complex portion out of plastic, considerable savings in manufacturing cost can be achieved.

FIGS. 5*a* through 5*e* show an alternate construction of a pistol gun barrel of steel 19 with integral locking block 21 manufactured from plastic. In this case the barrel may be pressed or molded into place. Again, the steel barrel shape is grossly simplified in comparison of equivalent all metal barrels with locking blocks.

FIGS. 6*a* through 6*d* show a plastic pistol magazine base 22 with integral tang 23 molded in the base of the magazine. The tang would be used to depress the spring loaded follower in another magazine assembly for ease in the loading of cartridges. Typically a pistol owner will have more than one magazine for the pistol, and depressing the follower with the user's finger rapidly becomes uncomfortable. Also, while a magazine space for a 38 or 9 mm bullet is normally long enough to hold more, the maximum number allowed is set by law. Consequently the plastic magazine base 22 with the integral tang 23 of the present invention may be incorporated in a magazine of otherwise conventional construction without impacting the shell capacity of the magazine.

Figure 7B:
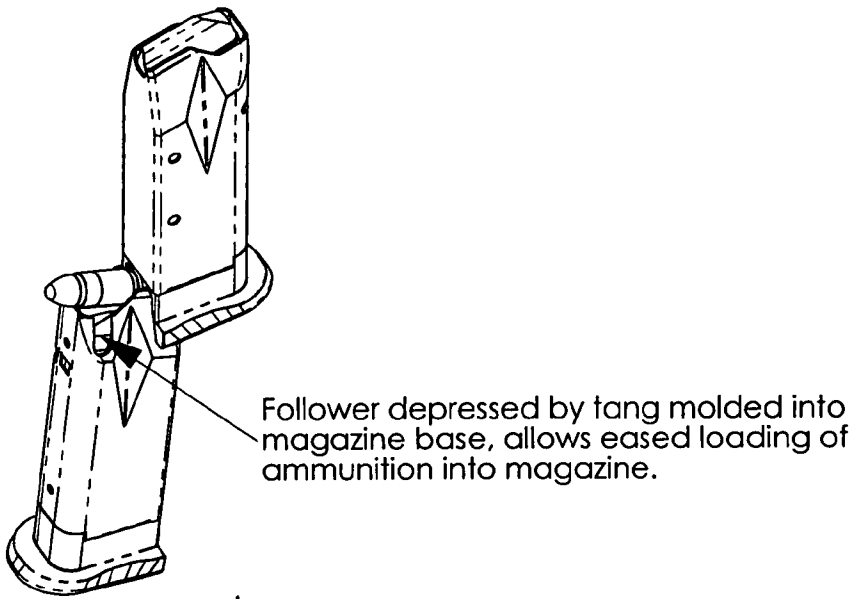
FIGS. 7*a* through 7*d* are views illustrating the use of the magazine base of FIGS. 6*a* through 6*d* in accordance with an embodiment of the present invention for the handgun of FIG. 1.
Figure 7C:
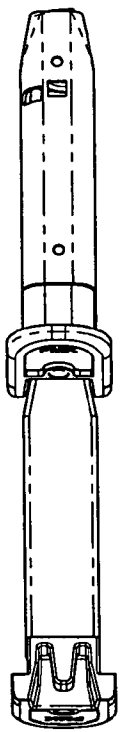
Figure 7D:
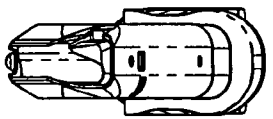
Figure 7A:
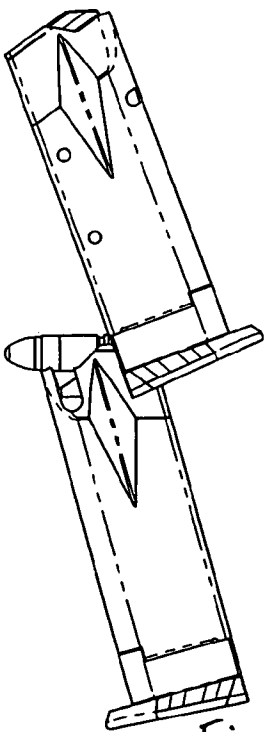
Figure 8A:
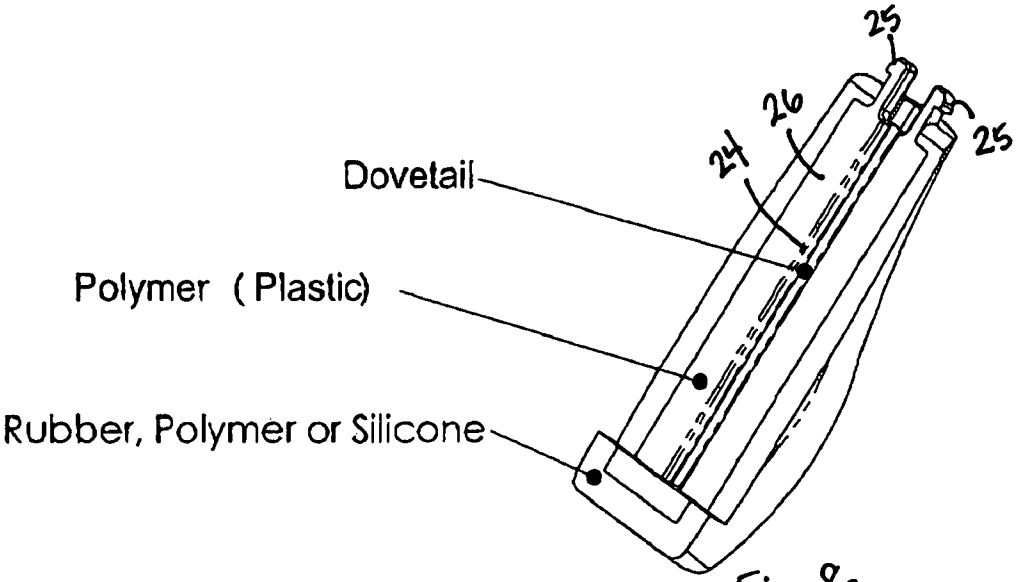
FIGS. 8*a* through 8*d* are views of a back strap in accordance with an embodiment of the present invention for the handgun of FIG. 1.
Figure 8B:
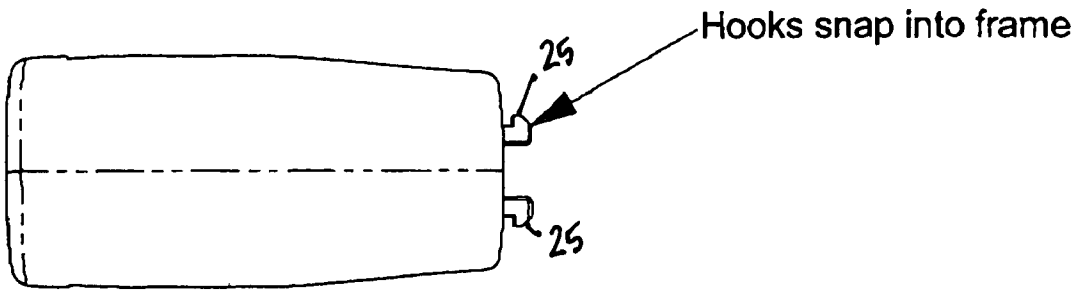
Figure 8C:
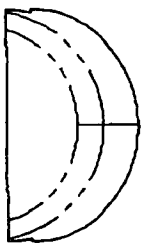
Figure 8D:
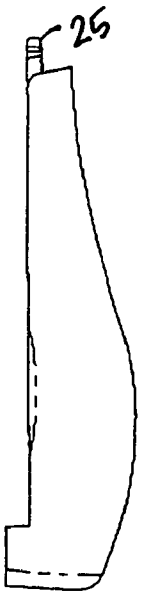

FIGS. 7*a* through 7*d* show how the magazine base of FIGS. 6*a* through 6*d* is used to aid in the loading of ammunition into another such magazine. Making the implement part of the magazine itself, together with the fact that most gun owners have an extra magazine assures the gun owner that the implement is always with him. As best seen in FIGS. 7*a* and 7*b*, the tang 23 is pressed against the rear of the last shell in the magazine to allow the next shell to be easily started loading into the magazine. Once in position to be captured as shown, the implement may be removed and the shell pushed back into its final loaded position.

FIGS. 8*a* through 8*d* show the construction of a removable backstrap for the handgrip of the handgun. The backstrap includes a dovetail 24 along its length with hooks 25 that snap into cooperatively disposed openings in the pistol frame to retain the backstrap until the hooks are deflected for release. The hooks and dovetail are molded as part of a plastic element 26 that may form the entire backstrap, or may form an insert for a rubber, silicone or polymer, typically a softer polymer.

Figure 10B:
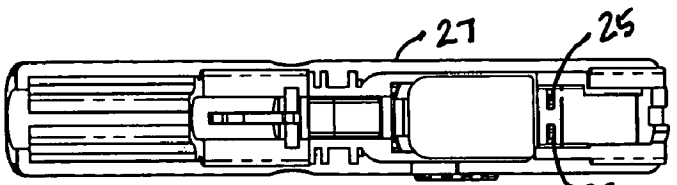
FIGS. 10*a* through 10*c* are views illustrating the attachment of the back strap of FIGS. 8*a* through 8*d* to a handgun frame of FIGS. 9*a* through 9*e* in accordance with an embodiment of the present invention.
Figure 10A:
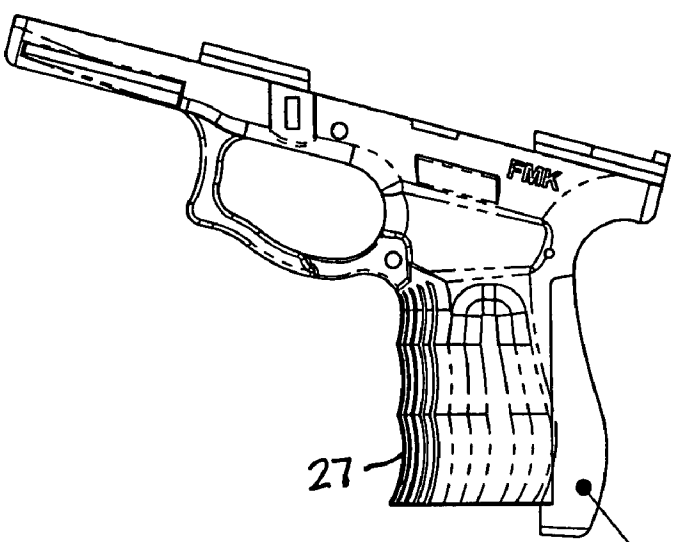
Figure 10C:
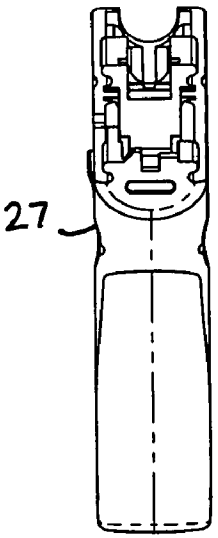

FIGS. 9*a* through 9*d* show details of a frame 27 that can accept and retain the removable backstrap. The entire frame 27 in the preferred embodiment is plastic, preferably molded to final dimensions, though as a minimum, the surfaces on which the slide is mounted are molded plastic. The mating dovetail 24 for the removable backstrap may be seen in FIG. 9*b*. The openings 28 for the hooks 25 on the removable backstrap may be seen in FIG. 9*d*. FIGS. 10*a* through 10*c* show the removable backstrap attached to the gun frame 27 (without magazine). For removal, the hook may simply be deflected toward each other for release from the frame.

Figure 11A:
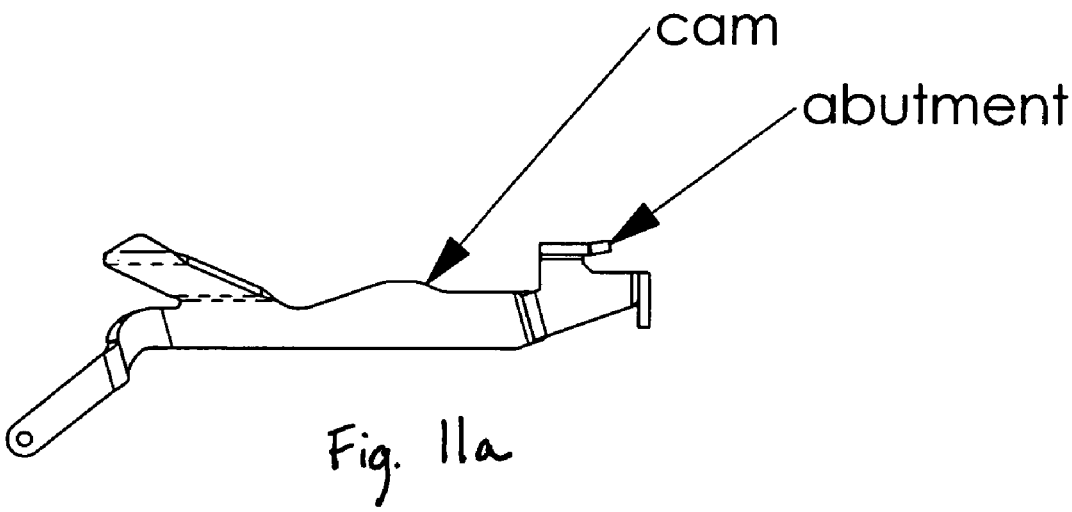
FIGS. 11*a* through 11*c* are views of a molded plastic trigger bar in accordance with an embodiment of the present invention for the handgun of FIG. 1.
Figure 11B:
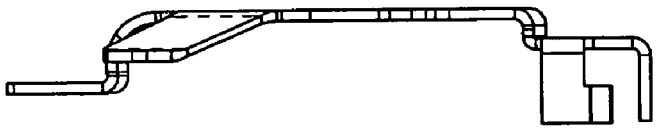
Figure 11C:
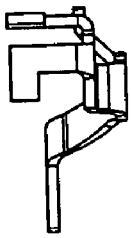
Figure 12C:
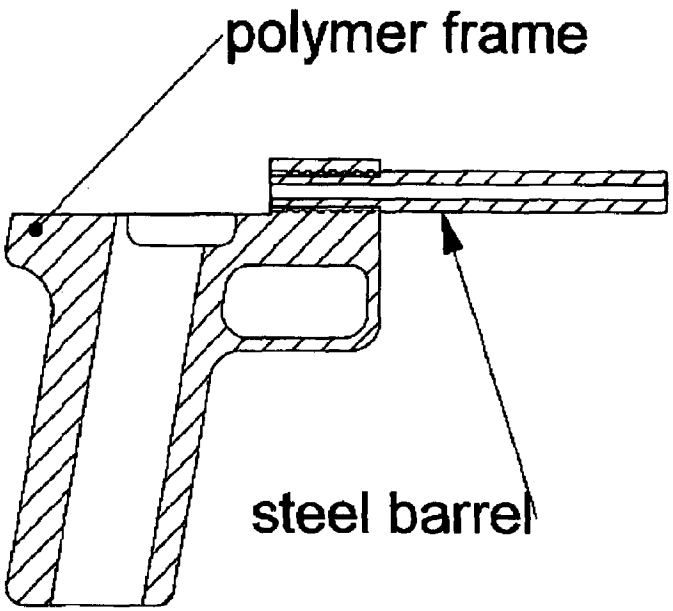
FIGS. 12*a* through 12*d* show the construction of a handgun with a rifled barrel molded directly into the pistol frame in accordance with an embodiment of the present invention.
Figure 12B:
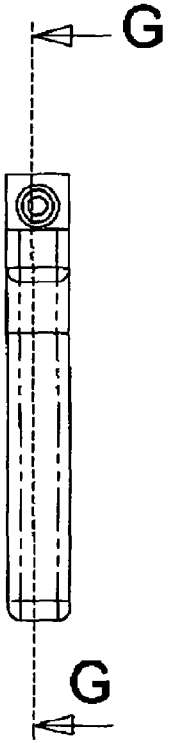
Figure 12A:
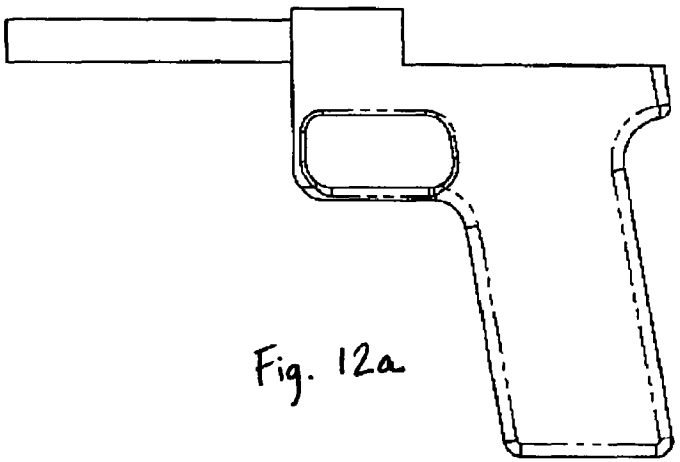
Figure 12D:
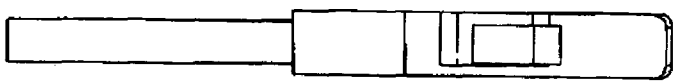

FIGS. 11*a* through 11*c* show a trigger bar, a part of the trigger-Safety-Trigger bar assembly 17 of FIG. 1. This too may be molded out of plastic, either using the same design as used in a metal part, or somewhat modified, perhaps reinforced with thicker sections, fillets and the like.

FIGS. 12*a* through 12*d* show the construction of a handgun with a rifled barrel 29 molded directly into the pistol frame 30. This firearm construction would be fitted with a slide that resists recoil by spring pressure only. This construction is referred to as a "straight blow back" design, which is different than the "locked breech" designs herein before described. This type of gun is illustrated in FIG. 13, providing an exploded view of a straight blow back design.

Figure 14A:
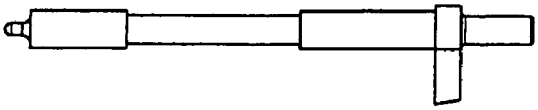
FIGS. 14*a* through 14*d* show the construction of firing pins for handguns in accordance with a preferred embodiment of the present invention.
Figure 14B:
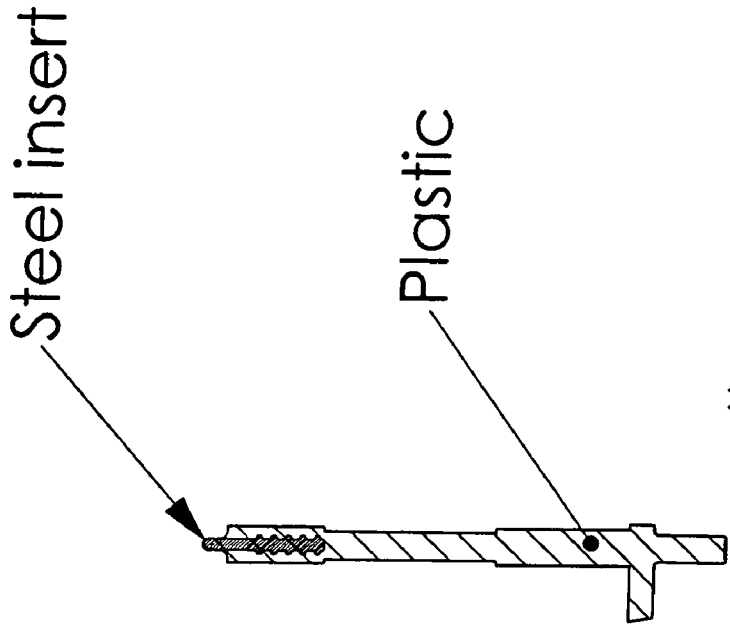
Figure 14C:
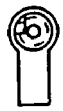
Figure 14D:
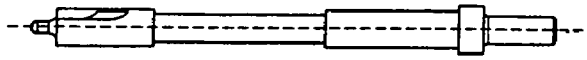

FIGS. 14*a* through 14*c* show a firing pin having a plastic body 31 with a steel insert 32 to pierce the primer of the pistol cartridge, thereby discharging the cartridge. The firing pin shown is specifically for a striker type handgun, though one may use a similar firing pin having a plastic body 33 with a steel insert in hammer type handguns, as shown in FIG. 14*d*. Also while one configuration of molded steel insert for the firing pin is shown, a larger/longer insert may be used, though preferably the insert is of a simple shape inexpensively manufactured, such as by rolling and heat treating before the plastic is molded around the pin.

The plastic used may be a filled plastic, such as a fiber filled injection molding plastic, or an unfilled plastic, depending on choice and need of a particular part. Possible plastics include nylon and polycarbonate. A filler, if used, may provide increased dimensional stability, reduced thermal expansion, and increased strength. Possible fillers include glass, glass fiber and mineral. Similarly, not all parts need be molded using the same plastic, as different plastics and/or filled and unfilled plastic may be used. In general, the parts preferably are configured using good design practices, such as relatively uniform plastic thickness, avoidance of stress concentration such as occur at step changes in cross section area, and good mechanical adhesion by roughened surfaces, grooves, etc. for molding plastic around metal parts. For handguns, good balance not only of the overall gun from a "feel" point of view is desired, but also balance in terms of things like the placement of the center of gravity of the slide on the center line of the barrel to minimize shock forces on the sliding surfaces is preferred. Also, minor changes in usual gun part proportions may be made, as well as some special provisions for use of plastic parts, such as, by way of example, one spring might be used for the usual slide motion, with a second spring, or a dual rate spring, used to limit excess slide motion without the shock of a fixed slide stop.

The various embodiments of plastic pistols and parts for plastic pistols disclosed herein are only representative of various designs that will be obvious from the disclosure herein and which reduce and simplify the metal parts for plastic pistols, allowing parts heretofore requiring expensive machining to be finish molded to dimension, or to be finish molded with a metal insert of a simple configuration, the complex machining required of the prior art being converted to inexpensive molding processes. It is believed that through the use of one or more aspects of the present invention in the design and manufacture of plastic pistols, high quality pistols may be manufactured at lower cost than in the prior art. While in general the various plastic gun parts disclosed herein are preferably molded to final dimensions, it may be advantageous or necessary to perform one or more machining operations on the molded parts, such as by way of example, the drilling of any necessary holes. In the claims to follow, a machined molded plastic part or surface thereof is obviously still a molded plastic part.

Thus while certain preferred embodiments of the present invention have been disclosed and described herein for purposes of illustration and not for purposes of limitation, it will be understood by those skilled in the art that various changes in form and detail may be made therein without departing from the spirit and scope of the invention.

What is claimed is:

1. In a handgun, the improvement comprising:

a slide of molded plastic having a steel insert forming a breech face; and, a handgun frame, the frame having molded plastic forming the surfaces against which mating plastic surfaces of the slide slides.

2. The improvement of claim 1 wherein the steel insert is molded into the slide.

3. The improvement of claim 1 wherein the steel insert is pressed into the slide.

4. The improvement of claim 1 wherein the entire frame is molded plastic.

5. The improvement of claim 1 further comprising a steel barrel having a molded plastic locking block.

6. The improvement of claim 5 wherein the plastic locking block is molded onto the steel barrel.

7. The improvement of claim 5 wherein the plastic locking block is pressed onto the steel barrel.

8. The improvement of claim 1 further comprising a firing pin, the firing pin being a molded plastic firing pin having a steel insert configured to pierce a primer of a pistol cartridge.

9. The improvement of claim 8 wherein the steel insert is molded into the firing pin.

10. The improvement of claim 1 further comprising a molded plastic trigger bar.

11. The improvement of claim 1 wherein the frame includes a grip portion having a dovetail along the back thereof, and further comprising a backstrap having a dovetail mating with the dovetail on the frame, and at least one hook at a top thereof for releasably engaging a cooperatively disposed surface of the frame when in position on the frame.

12. The improvement of claim 11 wherein the backstrap has a pair of hooks at a top thereof for releasably engaging cooperatively disposed surfaces of the frame when in position on the frame.

13. The improvement of claim 1 further comprising a magazine fitting within the frame, the magazine having a tang molded in the base of the magazine, the tang being configured to depress shells in a second magazine to accommodate the loading of additional shells.

14. In a handgun, the improvement comprising:

a slide of molded plastic having a steel insert forming a breech face;

a handgun frame, the frame having molded plastic forming the surfaces against which mating plastic surfaces of the slide slides; and, a steel barrel having a molded plastic locking block.

15. The improvement of claim 14 wherein the steel insert is molded into the slide.

16. The improvement of claim 14 wherein the steel insert is pressed into the slide.

17. The improvement of claim 14 wherein the entire frame is molded plastic.

18. The improvement of claim 14 wherein the plastic locking block is molded onto the steel barrel.

19. The improvement of claim 14 wherein plastic locking block is pressed onto the steel barrel.

20. The improvement of claim 14 further comprising a firing pin, the firing pin being a molded plastic firing pin having a steel insert configured to pierce a primer of a pistol cartridge.

21. The improvement of claim 20 wherein the steel insert is molded into the firing pin.

22. The improvement of claim 14 wherein the frame includes a grip portion having a dovetail along the back thereof, and further comprising a backstrap having a dovetail mating with the dovetail on the frame, and at least one hook at a top thereof for releasably engaging a cooperatively disposed surface of the frame when in position on the frame.

23. The improvement of claim 22 wherein the backstrap has a pair of hooks at a top thereof for releasably engaging cooperatively disposed surfaces of the frame when in position on the frame.

24. The improvement of claim 14 further comprising a magazine fitting within the frame, the magazine having a tang molded in the base of the magazine, the tang being configured to depress a follower and shells in a second magazine to accommodate the loading of additional shells.

25. In a handgun, the improvement comprising:

a slide; and, a handgun frame, wherein the handgun frame, including the surfaces of the handgun frame against which the slide slides, are molded plastic.

* * * * *